United States Patent [19]

Cavalieri D'Oro et al.

[11] Patent Number: 4,520,329

[45] Date of Patent: May 28, 1985

[54] CIRCUIT COMPONENT FOR SEPARATING AND/OR COMBINING TWO ISOFREQUENTIAL BUT DIFFERENTLY POLARIZED PAIRS OF SIGNAL WAVES LYING IN DIFFERENT HIGH-FREQUENCY BANDS

[75] Inventors: Enzo Cavalieri D'Oro, Monza; Piero Vita, Barcellona Pozzo Di Gotto, both of Italy

[73] Assignee: Italtel Societa Italiana Telecomunicazioni S.p.A., Milan, Italy

[21] Appl. No.: 469,141

[22] Filed: Feb. 23, 1983

[30] Foreign Application Priority Data

Feb. 25, 1982 [IT] Italy ..... 19845 A/82

[51] Int. Cl.[3] ..... H01P 1/213

[52] U.S. Cl. ..... 333/135; 333/21 A; 333/137; 333/208; 333/113

[58] Field of Search ..... 333/110, 113, 122, 126, 333/129, 132, 134, 135, 137, 136, 21 A, 21 R, 208, 211, 212; 343/756

[56] References Cited

U.S. PATENT DOCUMENTS

| | | | |
|---|---|---|---|
| 2,866,595 | 12/1958 | Marie | 333/110 X |
| 3,838,362 | 9/1974 | Kurtz | 333/135 |
| 4,030,048 | 6/1977 | Foldes | 333/208 X |
| 4,047,128 | 9/1977 | Morz | 343/756 X |

FOREIGN PATENT DOCUMENTS

| | | | |
|---|---|---|---|
| 97348 | 8/1979 | Japan | 333/135 |
| 124303 | 9/1980 | Japan | 333/113 |

*Primary Examiner*—Eugene R. Laroche
*Assistant Examiner*—Benny T. Lee
*Attorney, Agent, or Firm*—Karl F. Ross; Herbert Dubno

[57] ABSTRACT

A circuit component for separating and/or combining two pairs of high-frequency signal waves lying in different frequency bands, the waves of each pair having the same frequency but mutually orthogonal planes of polarization, comprises two mutually identical and aligned 3dB couplers bracketing a filtering assembly between them. Each 3dB coupler has a central guide of square cross-section surrounded by four collateral guides, each connected with the central guide by a coupling guide letting only the waves polarized in one plane—regardless of frequency—pass therebetween. The filtering assembly has sets of baffles in line with the central and collateral guides of both couplers, these baffles defining slots giving passage to only the waves of one of the two bands while reflecting the others. Waves in the pass band of the filtering assembly, admitted at an input end of the central guide of the first coupler, appear separately at output ends of the two collateral guides of the second coupler; waves rejected by the filtering assembly are reflected toward the input side of the first coupler and appear separately at the free ends of its collateral guides. Conversely, two isofrequential waves of mutally orthogonal polarization applied to the output ends of the collateral guides of the second coupler appear combined at the central input of the first coupler so that pairs of outgoing and incoming signal waves may be simultaneously transmitted to and received from an antenna connected to that input end.

5 Claims, 5 Drawing Figures

CIRCUIT COMPONENT FOR SEPARATING AND/OR COMBINING TWO ISOFREQUENTIAL BUT DIFFERENTLY POLARIZED PAIRS OF SIGNAL WAVES LYING IN DIFFERENT HIGH-FREQUENCY BANDS

FIELD OF THE INVENTION

Our present invention relates to a circuit component designed to separate two frequency bands in a double-polarization, very-high-frequency telecommunication system, particularly one serving for satellite telecommunication.

BACKGROUND OF THE INVENTION

The high costs of satellites and associated components have forced designers to make the most of the possibility of resorting to the so-called "recovery" of the frequencies, allowing the use of a single antenna for several pairs of signal channels of one and the same frequency, referred to hereinafter as isofrequential; the frequency of the transmission band differs from that of the reception band while the two channels of each pair differ from one another in the adopted polarization.

The present description consistently refers to linearly polarized signals, yet the following observations may also be applied to telecommunication systems operating with a circular polarization; as is well known to those skilled in the art, a linearly polarized signal may be transformed into a circularly polarized signal (and vice versa) for instance by placing the phase-shift axis of a 90° differential phase shifter (polarizer) at 45° with respect to the plane of the linearly polarized signal.

Let us consider a waveguide connected to an antenna and accommodating four groups of channels: two groups of isofrequential but differently polarized transmission channels and two groups of differently polarized isofrequential reception channels operating in a frequency band different from that of the transmission channels.

In order to separate the transmission channels from the reception channels it is necessary to use frequency discrimination; the polarization discrimination may be effected through orthogonal-mode transducers (OMT) or other devices well known in the art. In satellite systems there are utilized devices termed 0 dB double couplers that, besides separating the two bands by their frequencies, extract and supply to different outputs the channels of one of the two bands differing in their polarization.

A 0 dB double coupler consists of a central waveguide (having a circular or square section) where both frequency bands with both polarizations may propagate, and of four collateral waveguides that are symmetrically placed with respect to the central guide connected thereto by respective coupling waveguides so positioned as to give passage to signals present in one or the other polarization plane. The signals present in the central waveguide are thus separated according to their polarization: one pair of collateral guides, symmetrically disposed with respect to the central guide, receive the signals polarized in one (e.g. vertical) plane while the other guide pair receives those that are polarized in a second (e.g. horizontal) plane orthogonal to the first one.

Each coupling guide allows the transfer into the collateral guides of an energy portion of the signals present in the central guide that may propagate into the coupling guide; a complete transfer of the wave energy from the central guide to the collateral guides is obtained by suitably dimensioning the coupler.

Conversely, the coupler can be operated in a mode which is the dual of the one just described: the delivery of two signals equal in amplitude and phase into a pair of opposite collateral guides causes these signals to be fully transferred to the central guide where they are summed.

The coupling waveguides can be dimensioned as high-pass filters of poor efficiency: if the reception band is sufficiently remote from the transmission band, the two bands may be separated by so dimensioning the coupling waveguides that only the band having the higher frequency may propagate therein (e.g. the transmission band) whereas the other band propagates undisturbed in the central waveguide.

Commonly owned Italian Application No. 22821 A/81, filed 9 July 1981, relates to 0 dB couplers adapted to separate the reception band from the transmission band also when such bands are close to each other; the requisite frequency selectivity, allowing utilization of a 0 dB coupling in only one of the two bands, is obtained by way of rejection cavities formed in a wall of each lateral guide and placed in front of the coupling guides.

The rejection cavities are designed to be able to operate properly in only very narrow frequency bands; that reduces the field of utility of the device disclosed in the earlier Italian application.

OBJECTS OF THE INVENTION

An object of our present invention is to realize a band separator free from the restrictions of the known circuit components of this character.

Another object is to provide a circuit component of the type referred to which is able to separate two very wide and closely spaced frequency bands from each other.

SUMMARY OF THE INVENTION

Our improved circuit component, designed to separate two bands of doubly polarized very-high-frequency signals, comprises in cascade:

a first 3 dB double coupler formed by a central waveguide, adapted to allow propagation of the signals of both bands according to each of the two polarizations, and by four collateral waveguides symmetrically disposed with respect to the central waveguide, connected thereto by as many coupling waveguides designed to give passage to the signals of both bands having the same plane of polarization;

filtering elements of the band-pass type, in line with the central waveguide and the four collateral waveguides, that give passage to the signals of one one—for instance the higher—frequency band, these filtering elements being symmetrical with respect to both polarization planes and having the same electrical effects, in the central guide and in the lateral guides, upon the signals contained in the pass band and upon the reflected signals in the rejected band; and a second 3 dB double coupler, similar to and aligned with the first coupler.

BRIEF DESCRIPTION OF THE DRAWING

The above and other features of our invention will now be described in detail with reference to the accompanying drawing in which.

FIGS. *3a* and *3b* correspond to the upper half of FIG. 2 with insertion of symbols explaining the operation of the device.

SPECIFIC DESCRIPTION

Figure 1:
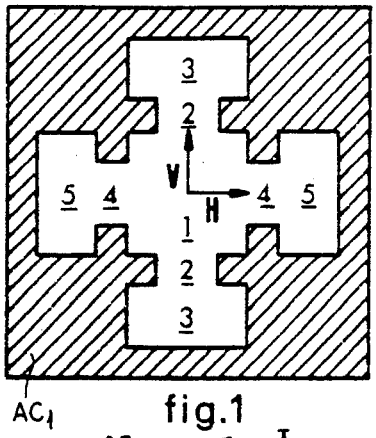
FIG. 1 is a cross-sectional view, taken on the line I—I of FIG. 2, of a 3 dB double coupler forming part of our improved band separator.

The device shown in the drawing is a 0 dB double coupler consisting of two mutually identical and aligned double couplers $AC_1$ and $AC_2$ bracketing a filter assembly PB between them. Each double coupler, as particularly illustrated for coupler $AC_1$ in FIG. 1, comprises:

- a central guide 1 (square-sectioned in the Figure) where high-frequency fields polarized in planes V and H may propagate, both in a transmission and in a reception band;
- a first pair of collateral guides 3 connected to the central guide 1 by a plurality of coupling guides 2, about $\lambda/4$ wide at the central frequency of the overall band, in which the energy of the fields polarized in plane V may propagate so as to be distributed between the central guide 1 and the collateral guides 3;
- a second pair of collateral guides 5, connected to the central guide 1 by a plurality of coupling guides 4 equal to guides 2, in which the energy of the fields polarized in plane H may propagate so as to be distributed between the central guide 1 and the collateral guides 5.

As noted above, a 3 dB double coupler has also a dual mode of operation, i.e. the energy of a field applied to the inputs of a pair of collateral guides is distributed between the collateral guides and the central guide.

Figure 2:
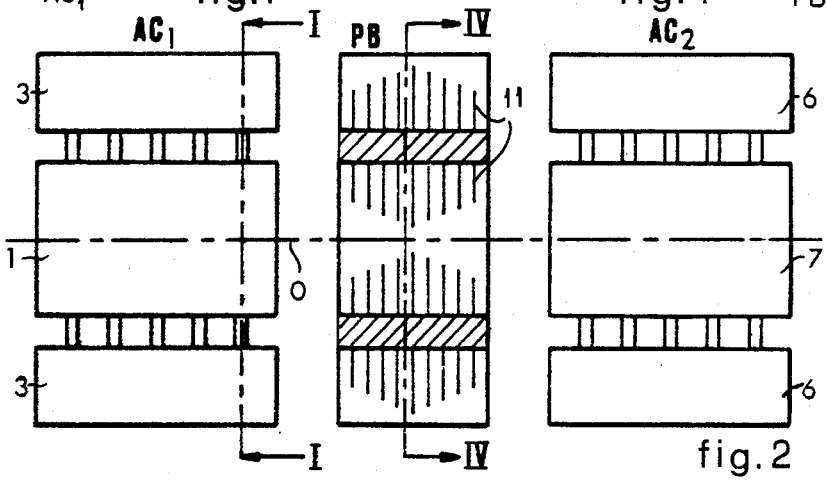
FIG. 2 diagrammatically shows a longitudinal section of a band separator according to our invention.
Figure 3A:
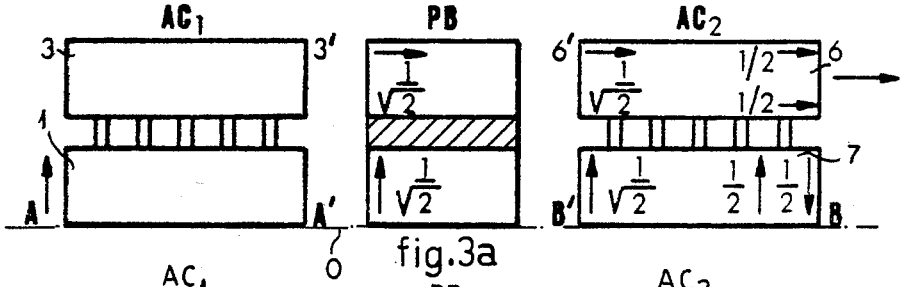
Figure 3B:
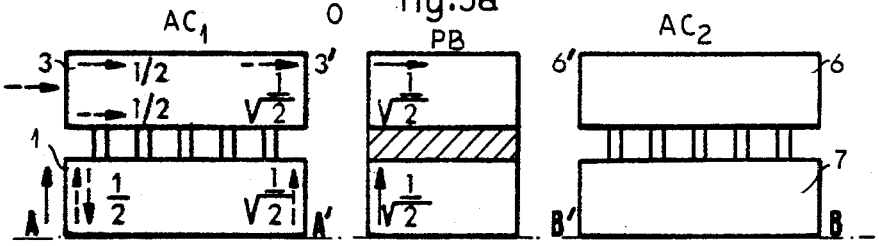

For the sake of clarity, the three elements $AC_1$, PB and $AC_2$ have been spaced apart along their axis O in FIG. 2. As regards the second coupler $AC_2$, its central and collateral guides have been labeled 7 and 6, respectively.

The filtering assembly PB is a plate with a square central cutout and four collateral cutouts respectively coextensive and aligned with the central and collateral guides of the two 3 dB double couplers. Each cutout is partly obstructed by baffles 11 arranged to allow only one of the two frequency bands to pass through while reflecting the other one. These baffles form T-shaped slots 8 in the collateral cutouts and orthogonally intersecting slots 9, 10—coinciding with polarization planes H, V—in the central cutout.

The baffles 11 in the central cutout have the same electrical properties as those placed in the collateral cutouts, providing a response curve of amplitude versus frequency so steep as to allow separation of the reception band from the transmission band; the baffles in the central cutout are identical with respect to both polarization planes.

FIG. *3a*, showing half of the device above the level of axis O, relates to signals lying in the pass band of filter assembly PB;

FIG. *3b* relates to signals lying in the inhibited band reflected by assembly PB.

For greater graphic and descriptive clarity, the attenuation and the phase shift introduced by the 3 dB double couplers and by filter PB (in its pass band) have been considered zero, as well as the angle of reflection; thus, the reflected signal is assumed to have the same amplitude and phase as the incident wave. In practice, both couplers and filter PB may modify the amplitude and/or the phase of the throughgoing and/or the reflected signals.

As indicated in FIG. *3a*, a signal of unity amplitude applied at A to the input end of guide 1 generates at the outputs A' and 3' of the first coupler $AC_1$ two signals of amplitude $1/\sqrt{2}$, relatively phase-shifted by $\pi/2$ (with the signal at A' leading the signal at 3'), that pass through filter PB and reach input ends 6' and B' of the second coupler $AC_2$; the combined effects of the two couplers make the signal applied at A available at the output end of collateral guide 6 while no signals appear at the output end B of the central guide 7. The two isofrequential signals contained in the pass band of filter PB may therefore be extracted individually and separately recovered, according to their polarizations, at the outputs of the two pairs of collateral guides of the second coupler $AC_2$.

According to the diagram of FIG. *3b*, filter PB completely reflects the signals available at outputs 3' and A' of the first coupler $AC_1$ that form part of the inhibited band; the reflected signals propagate backward in coupler $AC_1$ and the two-way travel causes the entire signal applied at A to be available at the entrance ends of the collateral guides 3 and 5 of the first coupler $AC_1$ while their combined amplitude is zero at A.

Thus, the four signal bands originally present at the central input end A (which may be connected to an antenna) become individually available at the opposite outputs of the two pairs of collateral guides. The aforementioned duality enables the simultaneous use of our device, connected to that antenna, for the separation of incoming waves and the combination of outgoing waves of different polarization.

An essential feature for the correct operation of our invention is that at least coupler $AC_1$ be a 3 dB double coupler for both the transmission and the reception band; member $AC_2$ need be a 3 dB coupler in only the pass band of filters PB, but for practical and symmetrical reasons it is more convenient to make the two couplers $AC_1$ and $AC_2$ mutually identical.

Our invention is particularly applicable to transmission systems where the transmission band is very close to the reception band; the minimum distance between the bands is determined only by the practical possibility and the economic advantage of building the filtering elements of assembly PB with a sufficiently steep response curve.

If the foregoing spacing between the transmission and the reception band is very great, it is enough that the coupling introduced by members $AC_1$ and $AC_2$ be of 3 dB type for only the frequency ranges occupied by the two bands; the filter PB is then only of secondary importance.

As diagrammatically shown in FIG. 2, the baffles 11 constituting the filtering elements—spaced apart by a distance of about $\lambda/2$ at the center of the pass range—are of varying height, symmetrically decreasing from the center toward the ends; suitable design of such a filter regarding number, position and height of the baffles will give it the desired response curve.

Figure 4:
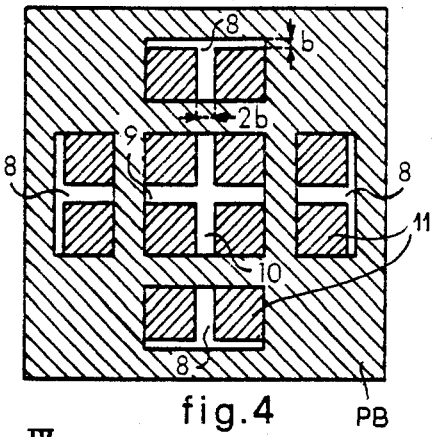
FIG. 4 is a cross-sectional view taken on the line IV—IV of FIG. 2.

As seen in FIGS. 2 and 4, the filtering elements of the central cutout of assembly PB are formed by four sets of baffles 11 having a symmetrical profile with respect to the midplanes passing through axis O and varying in height symmetrically with one another and with the baffles in the adjoining collateral cutouts. The T-shaped slots 8 defined by the collateral baffles have the bars of the T alongside the outer edges of cutouts and of a width b; for reasons of symmetry, the intersecting slots 9, 10 of the central baffles must define two vertically and two horizontally adjoining T's, disposed head-to-head, of the same dimensions so that these slots each have a width *2b*, corresponding to that of the inwardly pointing stems of the outer T's aligned therewith in planes H and V.

We claim:

1. A circuit component enabling the separation of four different high frequency signal waves constituting two signal pairs, each signal pair having signals in different planes of polarization and each signal pair lying in a different frequency band, comprising:

a first and a second 3 dB coupler of substantially identical structure aligned with each other and centered on a common axis; and filter means axially aligned with and bracketed between said couplers;

each of said couplers including a central guide and four collateral guides symmetrically disposed with reference to said axis, said central guide of said first coupler enabling propagation of all four signal waves applied to a free end thereof, each of said couplers including said central guide being coupled with said collateral guides by way of respective pairs of coupling guides, a first pair of said coupling guides giving passage to signal waves in either frequency band polarized in a first plane in which said first pair of coupling guides are oriented, a second pair of said coupling guides giving passage to signal waves in either frequency band polarized in a second plane in which said second pair of coupling guides are oriented, said filter means being a wave-reflecting body with a central cutout and four collateral cutouts, respectively aligned with the central and collateral guides of said first and second couplers, said cutouts being occupied by filtering elements of band-pass character passing only signal waves of one of said bands while reflecting the others toward the coupler through which they have been applied.

2. A circuit component as defined in claim 1 wherein said filtering elements are baffles perpendicular to said axis forming two mutually symmetrical sets in each collateral cutout and four mutually symmetrical sets in the central cutout, the sets in each collateral cutout defining a T-shaped slot with a bar alongside the outer edge of the respective cutout and an inwardly pointing stem lying in a respective plane of polarization, the sets in the central cutout defining two intersecting slots each lying in one of said planes of polarization.

3. A circuit component as defined in claim 2 wherein said intersecting slots and said stems have twice the width of said bars.

4. A circuit component as defined in claim 2 wherein the baffles of each set are spaced apart by about half a wavelength at the midfrequency of the pass band of said filter means.

5. A circuit component as defined in claim 2 wherein the baffles of each set symmetrically decrease in height from a central baffle outward.

* * * * *